US007047780B2

(12) United States Patent
Marando et al.

(10) Patent No.: US 7,047,780 B2
(45) Date of Patent: May 23, 2006

(54) APPARATUS FOR PERFORMING A HYDROFORMING OPERATION

(75) Inventors: Richard A. Marando, Mohrsville, PA (US); Eric M. Schrack, Shartlesville, PA (US); James C. Larkin, Hummelstown, PA (US); Edward Drost, Reading, PA (US); Jeffrey P. Dziki, Sewickley, PA (US); Joseph J. Vasalani, McKees Rocks, PA (US); Daniel E. Hunter, Export, PA (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/178,911

(22) Filed: Jun. 24, 2002

(65) Prior Publication Data

US 2003/0126902 A1 Jul. 10, 2003

Related U.S. Application Data

(60) Provisional application No. 60/301,929, filed on Jun. 29, 2001.

(51) Int. Cl.
*B21D 26/02* (2006.01)
*B21D 37/14* (2006.01)

(52) U.S. Cl. ..... 72/61; 72/455

(58) Field of Classification Search ..... 72/61, 72/455, 418; 100/231
See application file for complete search history.

(56) References Cited

U.S. PATENT DOCUMENTS 835,100 A * 11/1906 Devine ..... 72/61

(Continued)

FOREIGN PATENT DOCUMENTS

DE 2528153 3/1977

(Continued)

*Primary Examiner*—Lowell A. Larson
(74) *Attorney, Agent, or Firm*—MacMillan, Sobanski & Todd, LLC

(57) ABSTRACT

A hydroforming apparatus includes upper and lower platens that are connected together by tie rods extending through respective compression tubes. An upper die section is carried on the upper platen by a generally C-shaped suspension arm, while a lower die section is carried on the lower platen. The upper and lower die sections have recessed areas formed therein that define a die cavity. Lift assemblies are provided on the lateral ends of the hydroforming apparatus for selectively elevating the lower die section upwardly into engagement with the upper die section. When the lower die section is elevated by the lift assemblies, a workpiece is enclosed within the die cavity. A bolster is then moved between the hydroforming die and the lower platen. A cylinder array containing a plurality of pistons is next hydraulically actuated so as to securely clamp the hydroforming die between the cylinder array and the lower platen. While the cylinder array is actuated, pressurized fluid is supplied within the workpiece, deforming it into conformance with the die cavity.

19 Claims, 12 Drawing Sheets

U.S. PATENT DOCUMENTS

| | | | | |
|---|---|---|---|---|
| 3,247,783 | A | 4/1966 | Hammon | |
| 4,018,150 | A | 4/1977 | Shiokawa | |
| 4,601,422 | A | 7/1986 | Dumargue et al. | |
| 5,233,854 | A | 8/1993 | Bowman et al. | |
| 5,481,892 | A | 1/1996 | Roper et al. | |
| 5,482,454 | A | 1/1996 | Miyahara et al. | |
| 5,568,742 | A | 10/1996 | Bauer | |
| 5,600,983 | A | 2/1997 | Rigsby | |
| 5,735,156 | A | 4/1998 | Yoshitomi et al. | |
| 5,927,120 | A | 7/1999 | Marando | |
| 6,018,971 | A | 2/2000 | Kleinschmidt | |
| 6,298,701 | B1 | 10/2001 | Marando | |
| 6,536,251 | B1 * | 3/2003 | Marando et al. | 72/61 |

FOREIGN PATENT DOCUMENTS

| | | |
|---|---|---|
| EP | 686440 | 12/1995 |
| FR | 1595056 | 6/1970 |
| GB | 1318183 | 5/1973 |
| JP | 2001001066 | 1/2001 |

* cited by examiner

APPARATUS FOR PERFORMING A HYDROFORMING OPERATION

CROSS REFERENCE TO RELATED APPLICATION

This application claims the benefit of U.S. Provisional Application No. 60/301,929, filed Jun. 29, 2001, the disclosure of which is incorporated herein by reference.

BACKGROUND OF THE INVENTION

This invention relates in general to an apparatus for performing a hydroforming operation on a closed channel workpiece. In particular, this invention relates to an improved structure for such a hydroforming apparatus that is relative simple and inexpensive in structure and operation and is well suited for performing a hydroforming operation on relatively long workpieces, such as side rails for a vehicle frame assembly.

Hydroforming is a well known metal working process that uses pressurized fluid to deform a closed channel workpiece, such as a tubular member, outwardly into conformance with a die cavity having a desired shape. A typical hydroforming apparatus includes a frame having two or more die sections that are supported thereon for relative movement between opened and closed positions. The die sections have cooperating recesses formed therein that together define a die cavity having a shape corresponding to a desired final shape for the workpiece. When moved to the opened position, the die sections are spaced apart from one another to allow a workpiece to be inserted within or removed from the die cavity. When moved to the closed position, the die sections are disposed adjacent to one another so as to enclose the workpiece within the die cavity. Although the die cavity is usually somewhat larger than the workpiece to be hydroformed, movement of the two die sections from the opened position to the closed position may, in some instances, cause some mechanical deformation of the hollow member. In any event, the workpiece is then filled with a fluid, typically a relatively incompressible liquid such as water. The pressure of the fluid within the workpiece is increased to such a magnitude that the workpiece is expanded outwardly into conformance with the die cavity. As a result, the workpiece is deformed or expanded into the desired final shape. Hydroforming is an advantageous process for forming vehicle frame components and other structures because it can quickly deform a workpiece into a desired complex shape.

In a typical hydroforming apparatus, the die sections are arranged such that an upper die section is supported on a ram of the apparatus, while a lower die section is supported on a bed of the apparatus. A mechanical or hydraulic actuator is provided for raising the ram and the upper die section upwardly to the opened position relative to the lower die section, allowing the previously deformed workpiece to be removed from and the new workpiece to be inserted within the die cavity. The actuator also lowers the ram and the upper die section downwardly to the closed position relative to the lower die section, allowing the hydroforming process to be performed. To maintain the die sections together during the hydroforming process, a mechanical clamping device is usually provided. The mechanical clamping device mechanically engages the die sections (or, alternatively, the ram and the base upon which the die sections are supported) to prevent them from moving apart from one another during the hydroforming process. Such movement would obviously be undesirable because the shape of the die cavity would become distorted, resulting in unacceptable variations in the final shape of the workpiece.

As mentioned above, the hydroforming process involves the application of a highly pressurized fluid within the workpiece to cause deformation thereof. The magnitude of the pressure of the fluid within the workpiece will vary according to many factors, one of which being the physical size of the workpiece to be deformed. When a relatively small or thin-walled workpiece is being deformed, the magnitude of the pressure of the fluid supplied within the workpiece during the hydroforming operation is relatively small. Accordingly, the amount of the outwardly-directed force exerted by the workpiece on the die sections during the hydroforming operation is also relatively small. In these instances, only a relatively small amount of inwardly-directed force is required to be exerted by the hydroforming apparatus to counteract the outwardly-directed force so as to maintain the die sections in the closed position during the hydroforming operation. Consequently, the physical size and strength of the hydroforming apparatus when used for deforming relatively small or thin-walled workpieces is no greater than a typical mechanical press for performing a similar operation.

However, when a relatively large or thick-walled workpiece is being deformed (such as is found in many vehicle frame components, including side rails, cross members, and the like), the magnitude of the pressure of the fluid supplied within the workpiece during the hydroforming operation is relatively large. Accordingly, the amount of the outwardly-directed force exerted by the workpiece on the die sections during the hydroforming operation is also relatively large. To counteract this, a relatively large amount of inwardly-directed force is required to be exerted by the hydroforming apparatus to maintain the die sections in the closed position during the hydroforming operation. Consequently, the physical size and strength of the hydroforming apparatus is as large or larger than a typical mechanical press for performing a similar operation. This is particularly troublesome when the workpiece is relatively long, such as found in side rails for vehicle frames. The cost and complexity of manufacturing a conventional hydroforming apparatus that is capable of deforming such a workpiece is very high. Thus, it would be desirable to provide an improved structure for a hydroforming apparatus that is capable of deforming relatively large and thick-walled workpieces, yet which is relatively small, simple, and inexpensive in construction and operation.

SUMMARY OF THE INVENTION

This invention relates to an improved structure for a hydroforming apparatus that is capable of deforming relatively large and thick-walled workpieces, yet which is relatively small, simple, and inexpensive in construction and operation. The hydroforming apparatus includes upper and lower platens that are connected together by tie rods extending through respective compression tubes. An upper die section is carried on the upper platen by a generally C-shaped suspension arm, while a lower die section is carried on the lower platen. The upper and lower die sections have recessed areas formed therein that define a die cavity. Lift assemblies are provided on the lateral ends of the hydroforming apparatus for selectively elevating the lower die section upwardly into engagement with the upper die section. When the lower die section is elevated by the lift assemblies, a workpiece is enclosed within the die cavity. A bolster is then moved between the hydroforming die and the lower platen. A cylinder array containing a plurality of pistons is next hydraulically actuated so as to securely clamp the hydroforming die between the cylinder array and the lower platen. While the cylinder array is actuated, pressurized fluid is supplied within the workpiece, deforming it into conformance with the die cavity.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
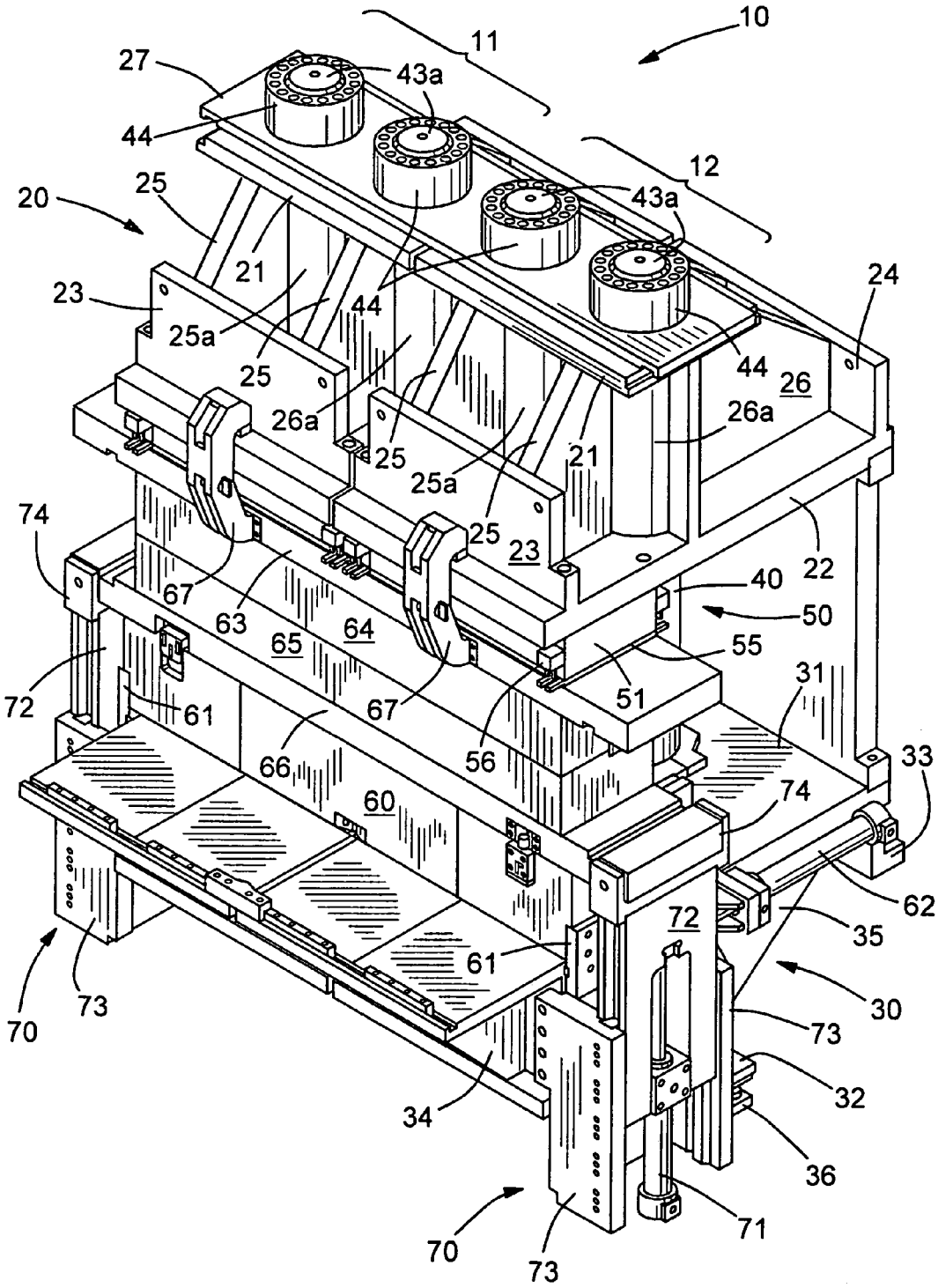
FIG. 1 is a perspective view of a portion of a hydroforming apparatus in accordance with this invention.
Figure 2:
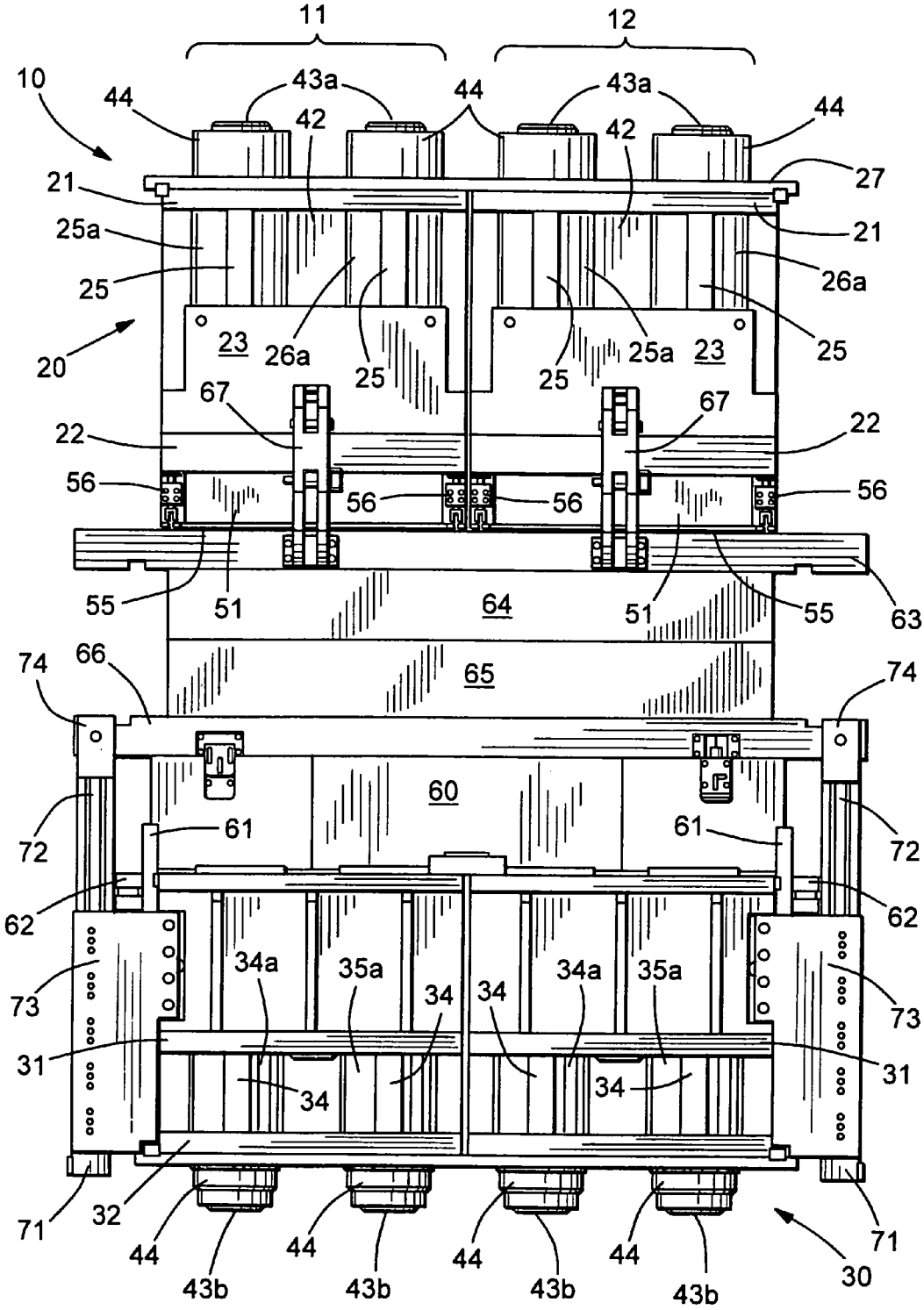
FIG. 2 is a front elevational view of the hydroforming apparatus illustrated in FIG. 1.
Figure 3:
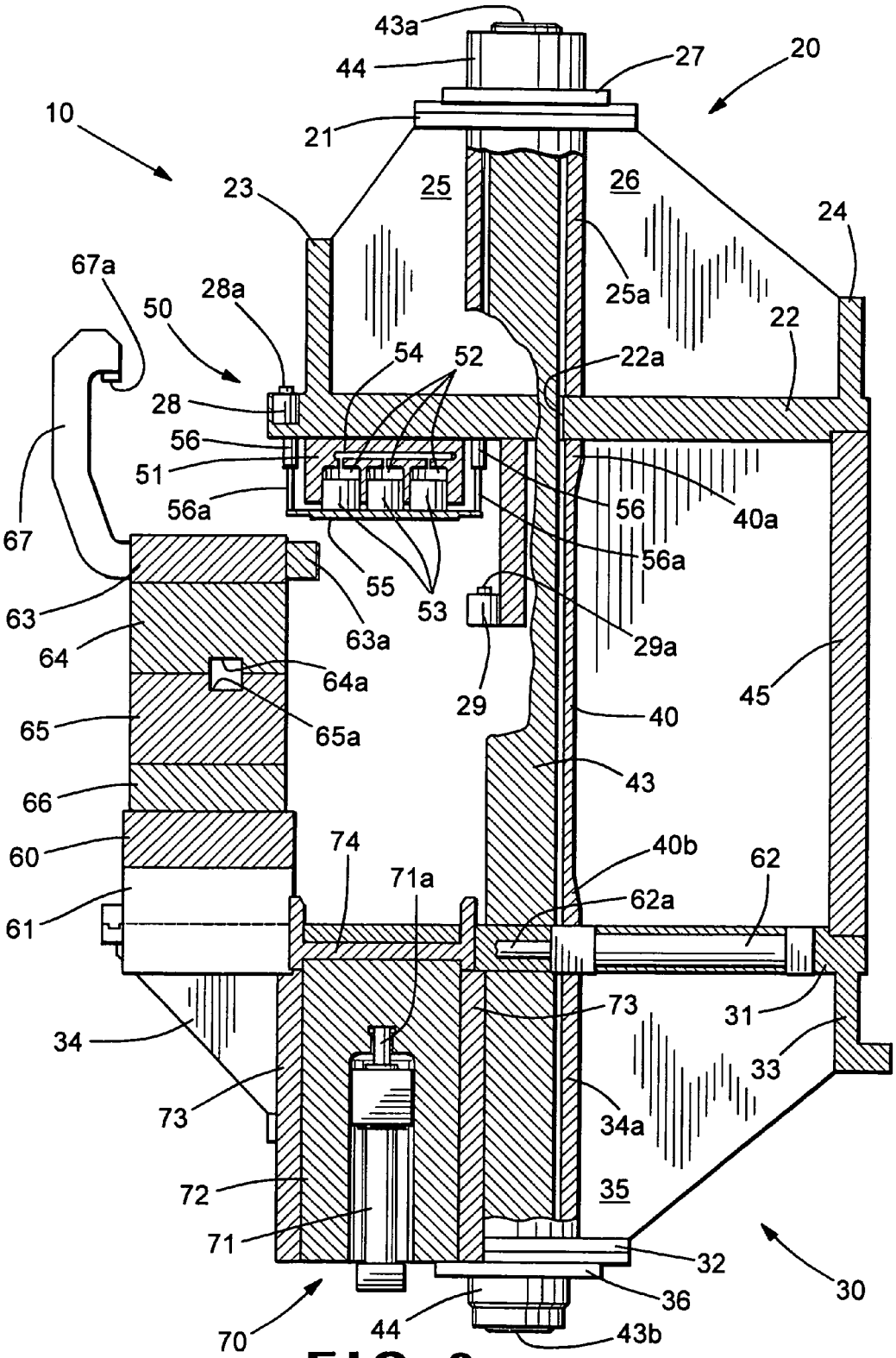
FIG. 3 is a sectional elevational view, partially broken away, of the hydroforming apparatus illustrated in FIG. 1 showing the components thereof prior to the installation of a hydroforming die within the hydroforming apparatus.

Referring now to the drawings, there is illustrated in FIGS. 1, 2, and 3 a hydroforming apparatus, indicated generally at 10, in accordance with this invention. The illustrated hydroforming apparatus 10 is of generally modular construction, including two hydroforming modules indicated at 11 and 12. The modules 11 and 12 are generally identical in structure and operation and can be arranged in side-by-side manner. Although two of such hydroforming modules 11 and 12 are shown, it will be appreciated that the hydroforming apparatus 10 may be formed having a greater or lesser number of such modules 11 and 12. Alternatively, the hydroforming apparatus 10 need not be formed having such a modular construction.

Each of the modules 11 and 12 of the hydroforming apparatus 10 includes an upper platen, indicated generally at 20. The illustrated upper platen 20 is generally box-shaped in construction, including an upper horizontally extending structural plate 21, a lower horizontally extending structural plate 22, a front vertically extending structural plate 23, and a rear vertically extending structural plate 24. In the illustrated embodiment, the front and rear vertically extending structural plates 23 and 24 are formed integrally with the lower horizontally extending structural plate 22, although such is not required. A first pair of laterally extending front reinforcement plates 25 and a second pair of laterally extending rear reinforcement plates 26 (only one is illustrated) are provided to increase the overall strength and rigidity of the upper platen 20. The upper platen 20 also includes a pair of upper platen tubes 25*a* and 26*a* that extend vertically between the upper horizontally extending structural plate 21 and the lower horizontally extending structural plate 22, and further are respectively disposed between the laterally extending front reinforcement plates 25 and the laterally extending rear reinforcement plates 26. The structural plates 21, 22, 23, and 24, the reinforcement plates 25 and 26, and the upper platen tubes 25*a* and 26*a* are connected to one another in any conventional manner, such as by welding, to form the upper platen 20. The lower ends of the upper platen tubes 25*a* and 26*a* are disposed about and are preferably co-axially aligned with respective openings (one of which is shown at 22*a*) formed through the lower horizontally extending structural plate 22 of the upper platen 20. The purpose for the upper platen tubes 25*a* and 26*a* and the openings 22*a* will be described below.

A transversely extending key plate 27 can extend across the upper horizontally extending structural plates 21 of each of the modules 11 and 12. The key plate 27 is provided to facilitate the alignment of such modules 11 and 12. To accomplish this, portions of the key plate 27 extend into cooperation with recesses (not shown) formed in the upper horizontally extending structural plates 21. However, the key plate 27 can be secured to or otherwise cooperate with the upper horizontally extending structural plates 21 in any desired manner.

A first hydraulic cylinder 28 (see FIG. 3) is supported on the lower horizontally extending structural plate 22 on the front side of each of the upper platens 20. Each of the first hydraulic cylinders 28 is conventional in the art and includes a piston rod 28*a* that is movable between extended and retracted positions. To accomplish this, the first hydraulic cylinders 28 are adapted to be selectively connected to a source of pressurized fluid (not shown). The purpose for the first hydraulic cylinders 28 will be explained below.

Similarly, a second hydraulic cylinder 29 (see FIG. 3) is supported on the lower horizontally extending structural plate 22 rearwardly of the first hydraulic cylinders 28 on each of the upper platens 20. Each of the second hydraulic cylinders 29 is conventional in the art and includes a piston rod 29*a* that is movable between extended and retracted positions. To accomplish this, the second hydraulic cylinders 29 are also adapted to be selectively connected to a source of pressurized fluid (not shown). The purpose for the second hydraulic cylinders 29 will be explained below.

Each of the modules 11 and 12 of the hydroforming apparatus 10 also includes a lower platen, indicated generally at 30. The illustrated lower platen 30 is also generally box-shaped in construction, including an upper horizontally extending structural plate 31, a lower horizontally extending structural plate 32, and a rear vertically extending structural plate 33. In the illustrated embodiment, the rear vertically extending structural plate 33 is formed integrally with the upper horizontally extending structural plate 31, although such is not required. A first pair of laterally extending front reinforcement plates 34 (only one is illustrated) and a second pair of laterally extending rear reinforcement plates 35 (only one is illustrated) are provided to increase the overall strength and rigidity of the lower platen 30. The lower platen 30 also includes a pair of lower platen tubes 34*a* and 35*a* that extend vertically between the upper horizontally extending structural plate 31 and the lower horizontally extending structural plate 32, and further are respectively disposed between the laterally extending front reinforcement plates 34 and the laterally extending rear reinforcement plates 35. The structural plates 31, 32, and 33, the reinforcement plates 34 and 35, and the lower platen tubes 34*a* and 35*a* are connected to one another in any conventional manner, such as by welding, to form the lower platen 30. The upper ends of the upper platen tubes 34*a* and 35*a* are disposed about and are preferably coaxially aligned with respective openings (not shown) formed through the upper horizontally extending structural plate 31 of the lower platen 30. The purpose for the lower platen tubes 34*a* and 35*a* and the openings will be described below. A transversely extending key plate 36 can extend across the lower horizontally extending structural plates 32 of each of the modules 11 and 12 in the same manner and for the same purpose as the key plate 27 described above.

The upper platen 20 and the lower platen 30 of each of the modules 11 and 12 are connected together by a pair of vertically extending compression tubes or members 40 and 41. The illustrated compression tubes 40 and 41 are generally hollow and cylindrical in shape and are each preferably formed having upper and lower ends, such as shown at 40*a* and 40*b* in FIG. 3, of increased wall thickness, although such is not necessary. The compression tubes 40 and 41 extend between the lower horizontally extending structural plate 22 of the upper platen 20 and the upper horizontally extending structural plate 31 of the lower platen 30. The upper ends 40*a* of the compression tubes 40 and 41 are disposed about and are preferably co-axially aligned with the openings 22*a* formed through the lower horizontally extending structural plate 22 of the upper platen 20. Similarly, the lower ends 40*b* of the compression tubes 40 and 41 are disposed about and are preferably co-axially aligned with the openings formed through the upper horizontally extending structural plate 31 of the lower platen 30. Thus, the compression tubes 40 and 41 are captured between the lower horizontally extending structural plate 22 of the upper platen 20 and the upper horizontally extending structural plate 31 of the lower platen 30. The compression tubes 40 and 41 are also vertically aligned with the upper platen tubes 25*a* and 26*a* and with the lower platen tubes 34*a* and 35*a*. If desired, a transversely extending supporting plate 42 (see FIG. 2) may be connected between the compression tubes 40 and 41 in any conventional manner, such as by welding, to increase the overall strength and rigidity of the compression tubes 40 and 41 and the hydroforming apparatus 10 as a whole.

A tie rod 43 extends through each of the compression tubes 40 and 41 from the upper platen tubes 25*a* and 26*a* of the upper platen 20 to the lower platen tubes 34*a* and 35*a* of the lower platen 30. Each of the tie rods 43 is a generally solid cylindrical member having an upper end portion 43*a* that extends above the upper horizontally extending structural plate 21 of the upper platen 20 and a lower end portion 43*b* that extends below the lower horizontally extending structural plate 32 of the lower platen 30. In the illustrated embodiment, the upper and lower end portions 43*a* and 43*b* of the tie rod 43 are threaded, and nuts 44 or similar retaining devices are threaded onto such threaded end portions 43*a* and 43*b* to connect the tie rods 43 to the compression tubes 41. When tightened, the nuts 44 are drawn into engagement with the upper horizontally extending structural plate 21 of the upper platen 20 and the lower horizontally extending structural plate 32 of the lower platen 30, as well as the upper and lower end portions 40*a* and 40*b* of the compression tubes 40. As a result, the compression tubes 40 are pre-stressed with compressive forces between the lower horizontally extending structural plate 22 of the upper platen 20 and the upper horizontally extending structural plate 31 of the lower platen 30, for a purpose that will be explained below. If desired, structures other than the illustrated threaded end portions 43*a* and 43*b* and nuts 44 may be used for accomplishing these purposes. A backing plate 45 extends between the lower horizontally extending structural plate 22 of the upper platen 20 and the upper horizontally extending structural plate 31 of the lower platen 30 for a purpose that will also be explained below. An upper die clamping assembly, indicated generally at 50, is provided on the upper platen 20 for each of the modules 11 and 12. In the illustrated embodiment, the upper die clamping assembly 50 is secured to the lower horizontally extending structural plate 22 of the upper platen 20, although such is not necessary. The upper die clamping assembly 50 includes a cylinder array 51 that is provided on the upper platen 20. In the illustrated embodiment, the cylinder array 51 is secured to the lower horizontally extending structural plate 22 of the upper platen 20 in any conventional manner, such as by welding, and extends laterally throughout each of the modules 11 and 12. The cylinder array 51 has a plurality of hollow cylinders 52 formed in the lower surface thereof. The quantity and location of such hollow cylinders 52 may be determined as necessary to perform the hydroforming operation described below. A piston 53 is disposed in each of the hollow cylinders 52 for limited upward and downward movement in the manner described below. A plurality of passageways 54 are formed through the cylinder array 51 such that the hollow cylinders 52 are in fluid communication with one another. The passageways 54 selectively communicate with a source of pressurized fluid (not shown). The purpose for the cylinder array 51 and the pistons 53 will be explained below.

A retainer plate 55 is provided on the cylinder array 51 for retaining the pistons 53 within the cylinders 52. The retainer plate 55 is supported on the lower horizontally extending structural plate 22 of the upper platen 20 by a plurality of support assemblies 56. In the illustrated embodiment, a first pair of hydraulic support cylinders 56 are provided on the front side of the cylinder array 51, and a second pair of support cylinders 56 (only one is shown in FIG. 3) are provided on the rear side of the cylinder array 51. However, any number of such support cylinders 56 may be provided at any desired locations. Each of the support cylinders 56 is conventional in the art and includes a piston rod 56*a* that is movable between extended and retracted positions. To accomplish this, the support cylinders 56 are adapted to be selectively connected to a source of pressurized fluid (not shown). The purpose for the support cylinders 56 will be explained below.

A moving bolster 60 is supported on the upper surface of the upper horizontally extending structural plate 31 of the lower platen 30. In the illustrated embodiment, the moving bolster 60 extends laterally across both of the adjacent upper horizontally extending structural plates 31 of the lower platens 30 associated with the two modules 11 and 12, although such is not necessary. The moving bolster 60 is supported on the upper surface of the upper horizontally extending structural plate 31 for sliding horizontal movement between extended and retracted positions, as will be explained in greater detail below. The moving bolster 60 may be supported directly on the upper surface of the upper horizontally extending structural plate 31 as shown, or may alternatively be supported on rollers or bearings provided on the upper surface of the upper horizontally extending structural plate 31. A pair of side plates 61 are secured to the lateral ends of the moving bolster 60 for a purpose that will be explained below.

A pair of hydraulic slide cylinders 62 (only one is illustrated) are provided on the lateral ends of the hydroforming apparatus 10 to effect sliding movement of the moving bolster 60 between the extended and retracted positions. In the illustrated embodiment, the slide cylinders 62 are secured to the upper horizontally extending structural plates 31 of the two modules 11 and 12. However, the slide cylinders 62 may be supported on any convenient support surface. Each of the slide cylinders 62 has a movable piston rod 62*a* extending outwardly therefrom. The outer ends of the piston rods 62*a* are secured to the side plates 61 that, as mentioned above, are secured to the lateral ends of the moving bolster 60. The slide cylinders 62 are adapted to be selectively connected to a source of pressurized fluid (not shown) to effect extension and retraction of the piston rods 62*a* and, therefore, sliding movement of the moving bolster 60 between the extended and retracted positions.

A hydroforming die, including an upper die mounting plate 63, an upper die section 64, a lower die section 65, and a lower die mounting plate 66, is supported on the moving bolster 60. The upper surface of the upper die section 64 is secured to the upper die mounting plate 63, while the lower surface of the upper die section 64 has a recessed area 64*a* formed therein. Similarly, the lower surface of the lower die section 65 is secured to the lower die mounting plate 66, while the upper surface of the lower die section 65 has a recessed area 65*a* formed therein. The upper die mounting plate 63 has a rearwardly extending protrusion 63*a* provided thereon, for a purpose that will be described below.

When the upper and lower die sections 64 and 65 are moved together, such as shown in FIG. 3, the recessed areas 64*a* and 65*a* cooperate to define a hydroforming cavity that extends transversely throughout the hydroforming die. As best shown in FIG. 1, the ends of the upper die mounting plate 63 and the lower die mounting plate 66 extend laterally from the ends of the upper die section 64 and the lower die section 65. The upper die mounting plate 63 has a generally C-shaped suspension arm 67 secured to the front side thereof. The suspension arm 67 has an inwardly extending upper end 67*a* provided thereon. The purpose for the suspension arm 67 and the inwardly extending end 67*a* will be explained below.

A lift assembly, indicated generally at 70, is provided on each of the lateral ends of the hydroforming apparatus 10. Each of the lift assemblies 70 includes a hydraulic lift cylinder 71 that is secured to the lower platen 30 of the hydroforming apparatus 10 or other support surface. Each of the lift cylinders 71 is conventional in the art and includes a piston rod 71*a* that is vertically movable between extended and retracted positions. To accomplish this, the lift cylinders 71 are adapted to be selectively connected to a source of pressurized fluid (not shown). Each of the lift assemblies 70 further includes a lift member 72 that is associated with the lift cylinder 71. The lift members 72 are shaped generally in the form of an inverted U and are connected to the respective pistons rods 71*a* for vertical movement therewith. To facilitate such vertical movement, each of the lift members 72 is disposed between a pair of lift guides 73. The lift guides 73 are secured to the lower platen 30 of the hydroforming apparatus 10 or other support surface and slidably engage the sides of the associated lift member 72. Thus, when the lift cylinders 71 are actuated, the lift member 72 can be selectively raised and lowered relative to the lower platen 30. A generally U-shaped lift support 74 can be secured to (or, alternatively, formed integrally with) the upper end of each of the lift members 72, for a purpose that will be explained below.

The operation of the hydroforming apparatus 10 will now be described. Initially, the hydroforming die must be installed within the hydroforming apparatus 10. To accomplish this, the various components of the hydroforming apparatus 10 are oriented in the positions illustrated in FIG. 3, and the hydroforming die is disposed on top of the moving bolster 60. In this initial arrangement, the passageways 54 formed through the cylinder array 51 do not communicate with the source of pressurized fluid. Thus, although the pistons 53 and the retainer plate 55 depend from the cylinder array 51 under the influence of gravity to the extent permitted by the support cylinders 56, no pressure is exerted thereby.

Figure 4:
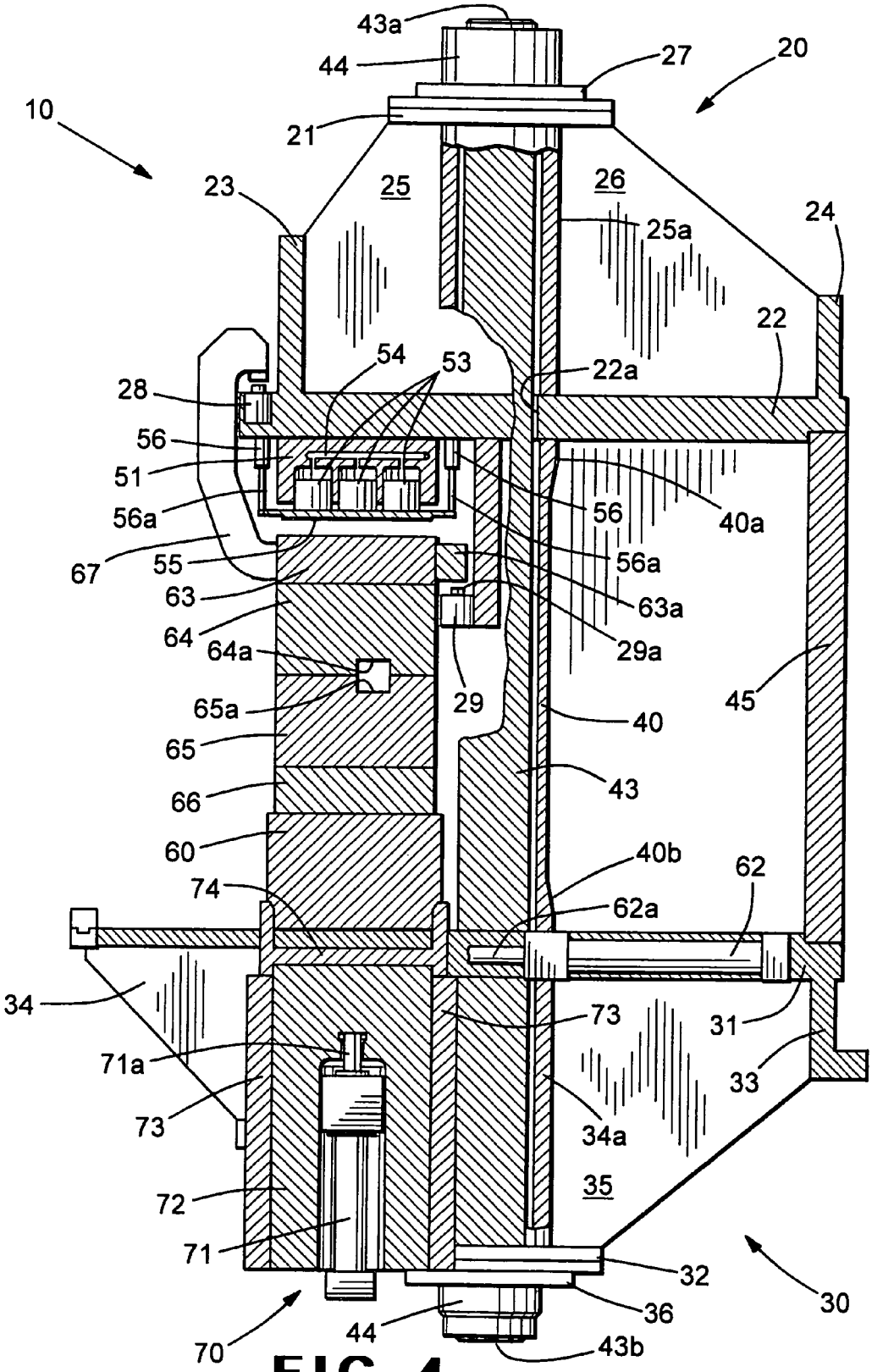
FIG. 4 is a sectional elevational view similar to FIG. 3 showing the moving bolster after being moved inwardly within the hydroforming apparatus to begin the installation of the hydroforming die.

To install the hydroforming die within the hydroforming apparatus 10, the hydraulic slide cylinders 62 are initially actuated as shown in FIG. 4 to move the moving bolster 60 and the hydroforming die inwardly within the hydroforming apparatus 10. In this position, the moving bolster 60 and the hydroforming die are vertically aligned with the upper die clamping assembly 50. In particular, the upper end 67*a* of the suspension arm 67 is disposed directly above the first hydraulic cylinder 28, while the rearwardly extending protrusion 63*a* of the upper die mounting plate 63 is disposed directly above the second hydraulic cylinder 29.

Figure 5:
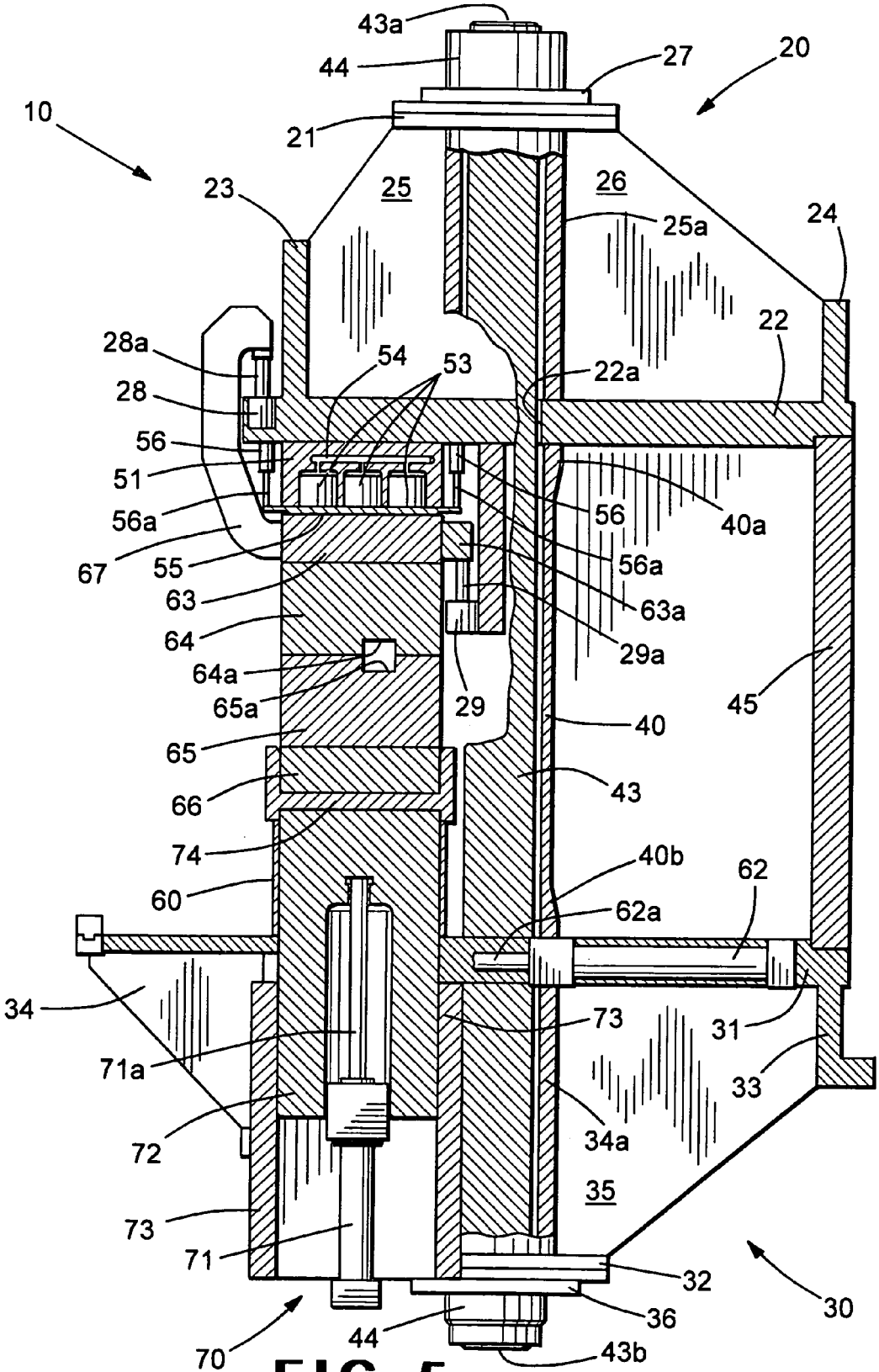
FIG. 5 is a sectional elevational view similar to FIG. 4 showing the lift cylinders after being actuated to raise the hydroforming die above the moving bolster during the installation of the hydroforming die.

Then, as shown in FIG. 5, the lift cylinders 71 are actuated to extend the lift member 72 and the lift support 74 upwardly relative to the lower platen 30. As mentioned above, the ends of the upper die mounting plate 63 and the lower die mounting plate 66 extend laterally from the ends of the upper die section 64 and the lower die section 65. Such ends of the lower die mounting plate 66 are received within the U-shaped lift support 74 such that the hydroforming die, including the upper die mounting plate 63, the upper die section 64, the lower die section 65, and the lower die mounting plate 66, is raised upwardly with the lift member 72. In this elevated position, the upper surface of the upper die mounting plate 63 abuts the lower surface of the retainer plate 55. As also mentioned above, the passageways 54 formed through the cylinder array 51 do not communicate with the source of pressurized fluid. Thus, the upward movement of the hydroforming die causes the retainer plate 55 to be moved upwardly as well, causing the pistons 53 to be retracted within their associated cylinders 52. At the same time, the first and second hydraulic cylinders 28 and 29 are actuated to extend their associated pistons 28*a* and 29*a*. The piston 28*a* is extended into engagement with the upper end of the C-shaped suspension arm 67 secured to the upper die mounting plate 63, while the piston 29*a* is extended into engagement with the rearwardly extending protrusion 63*a* provided on the upper die mounting plate 63.

Figure 6:
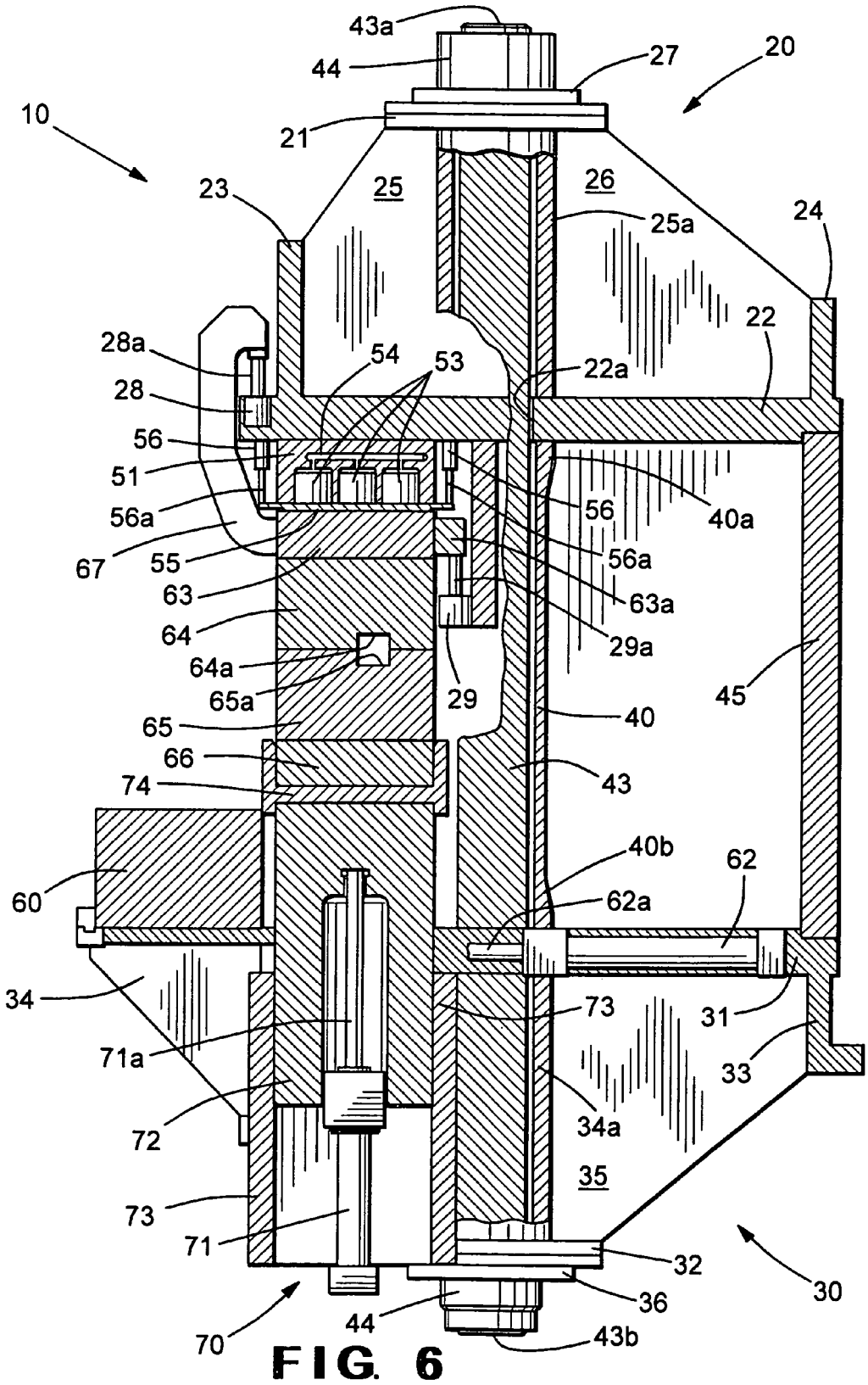
FIG. 6 is a sectional elevational view similar to FIG. 5 showing the moving bolster after being moved outwardly from the hydroforming apparatus during the installation of the hydroforming die.
Figure 7:
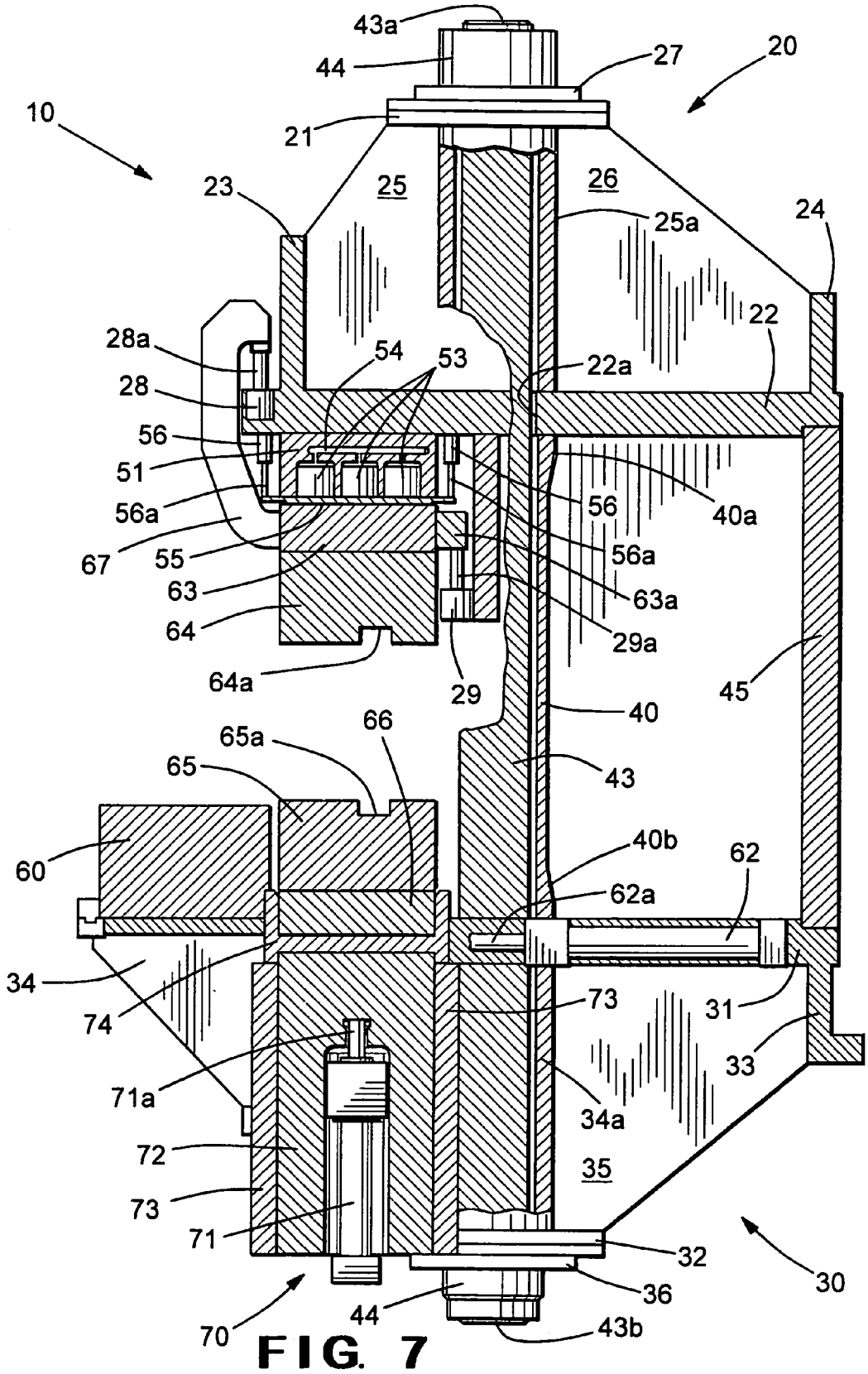
FIG. 7 is a sectional elevational view similar to FIG. 6 showing the lift cylinders after being actuated to lower the lower die section of the hydroforming die to complete the installation of the hydroforming die.

Next, the hydraulic slide cylinders 62 are actuated as shown in FIG. 6 to move the moving bolster 60 outwardly from the hydroforming apparatus 10. However, because the lift cylinders 71 remain extended, the hydroforming die remains disposed within the hydroforming apparatus 10. Lastly, the lift cylinders 71 are actuated as shown in FIG. 7 to lower the lift member 72, the lift support 74, the lower die mounting plate 66, and the lower die section 65. The first and second hydraulic cylinders 28 and 29, however, continue to support the upper die mounting plate 63 and the upper die section 64. This completes the die installation process for the hydroforming apparatus 10, which is now ready to perform a hydroforming operation.

Figure 8:
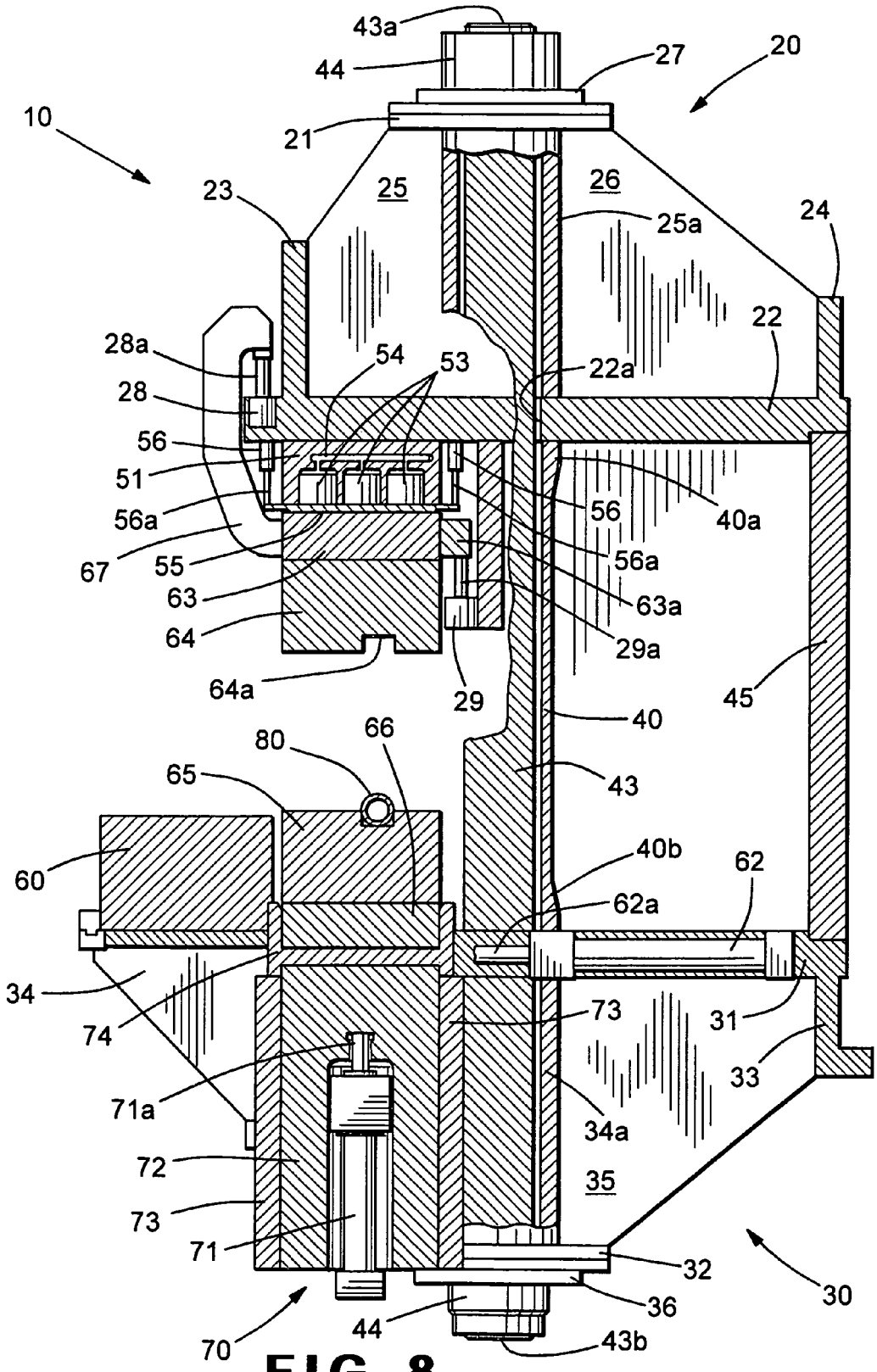
FIG. 8 is a sectional elevational view similar to FIG. 7 showing the insertion of a workpiece within the recess formed in the lower die section of the hydroforming die to begin the hydroforming process.

The initial step in the cycle of the hydroforming operation is also shown in FIG. 8, wherein a workpiece 80 is inserted between the upper and lower die sections 64 and 65, respectively. Because the lower die section 65 has been lowered relative to the upper die section 64, clearance is provided to insert the workpiece 80 therebetween.

The workpiece 80 is a closed channel structural member, such as a tubular member, that may be pre-bent in a known manner to achieve a predetermined rough shape for the final hydroformed component. Any conventional mechanism (not shown) can be used to insert the workpiece 80 between the upper die section 64 and the lower die section 65. Typically, the workpiece 80 will be placed within the recessed area 65*a* formed in the lower die section 65. The workpiece 80 is preferably sized such that the ends thereof extend a predetermined distance transversely from each side of the hydroforming die. This is done to facilitate the connection of conventional end feed cylinders (not shown) thereto to perform the hydroforming process, as will be explained in further detail below.

Figure 9:
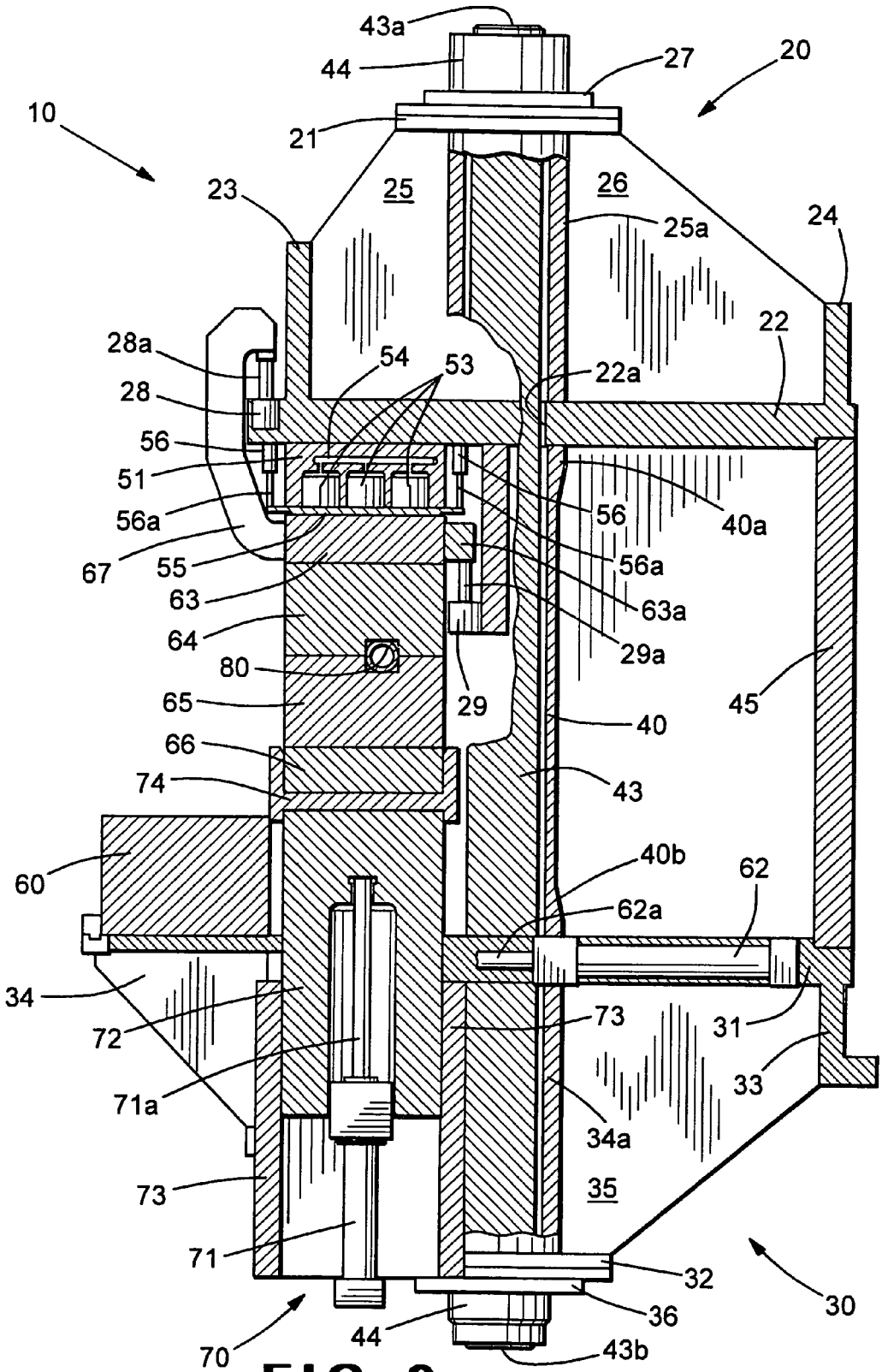
FIG. 9 is a sectional elevational view similar to FIG. 8 showing the lift cylinders after being actuated to lift the lower die section into engagement with the upper die section of the hydroforming die during the hydroforming process.

Next, the pistons 71*a* of the lift cylinders 71 are actuated to elevate the lower die section 65 and the lower die mounting plate 66 upwardly relative to the upper die mounting plate 63 and the upper die section 64 to an uppermost position shown in FIG. 9. The lift cylinders 71 are preferably relatively small in size so as to selectively effect relatively high velocity, low force exertion movement of the pistons 71*a*. As a result, the majority of the elevational movement of the lower die section 65 and the lower die mounting plate 65 can be performed relatively quickly, which advantageously reduces the overall cycle time of the hydroforming apparatus. However, it may be desirable for the lift cylinders 71 to exert a sufficiently large magnitude of force as to cause some deformation of the workpiece 80 when the lower die section 65 engages the upper die section 64.

Figure 10:
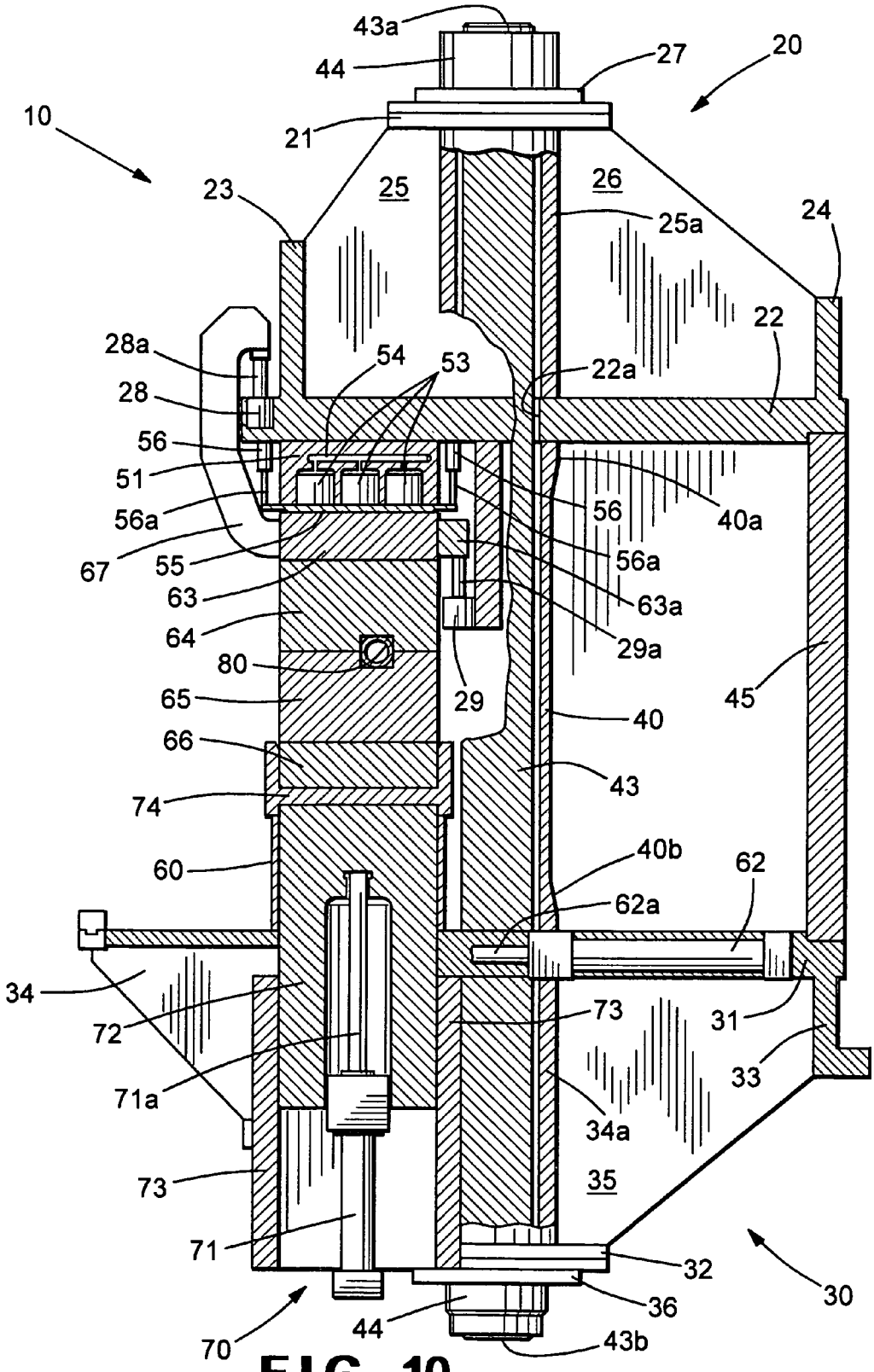
FIG. 10 is a sectional elevational view similar to FIG. 9 showing the moving bolster after being moved inwardly within the hydroforming apparatus during the hydroforming process.

When the lower die section 65 and the lower die mounting plate 66 have been moved upwardly relative to the upper die mounting plate 63 and the upper die section 64 to the uppermost position shown in FIG. 9, the lower surface of the lower die mounting plate 66 is positioned slightly above the upper surface of the moving bolster 60. Accordingly, the hydraulic slide cylinders 62 can then be actuated to again move the movable bolster 60 inwardly within the hydroforming apparatus 10, beneath the hydroforming die as shown in FIG. 10.

Then, piston 71*a* of the lift cylinder 71, the piston 28*a* of the first hydraulic cylinder, and the piston 29*a* of the second hydraulic cylinder 29 are all retracted such that the hydroforming die is lowered onto the upper surface of the moving bolster 60. Because the clearance between the lower surface of the lower die mounting plate 66 and the upper surface of the moving bolster 60 is relatively small, the distance that the hydroforming die is lowered is also relatively small. As a result, the hydroforming die is positively supported on the moving bolster 60.

Figure 11:
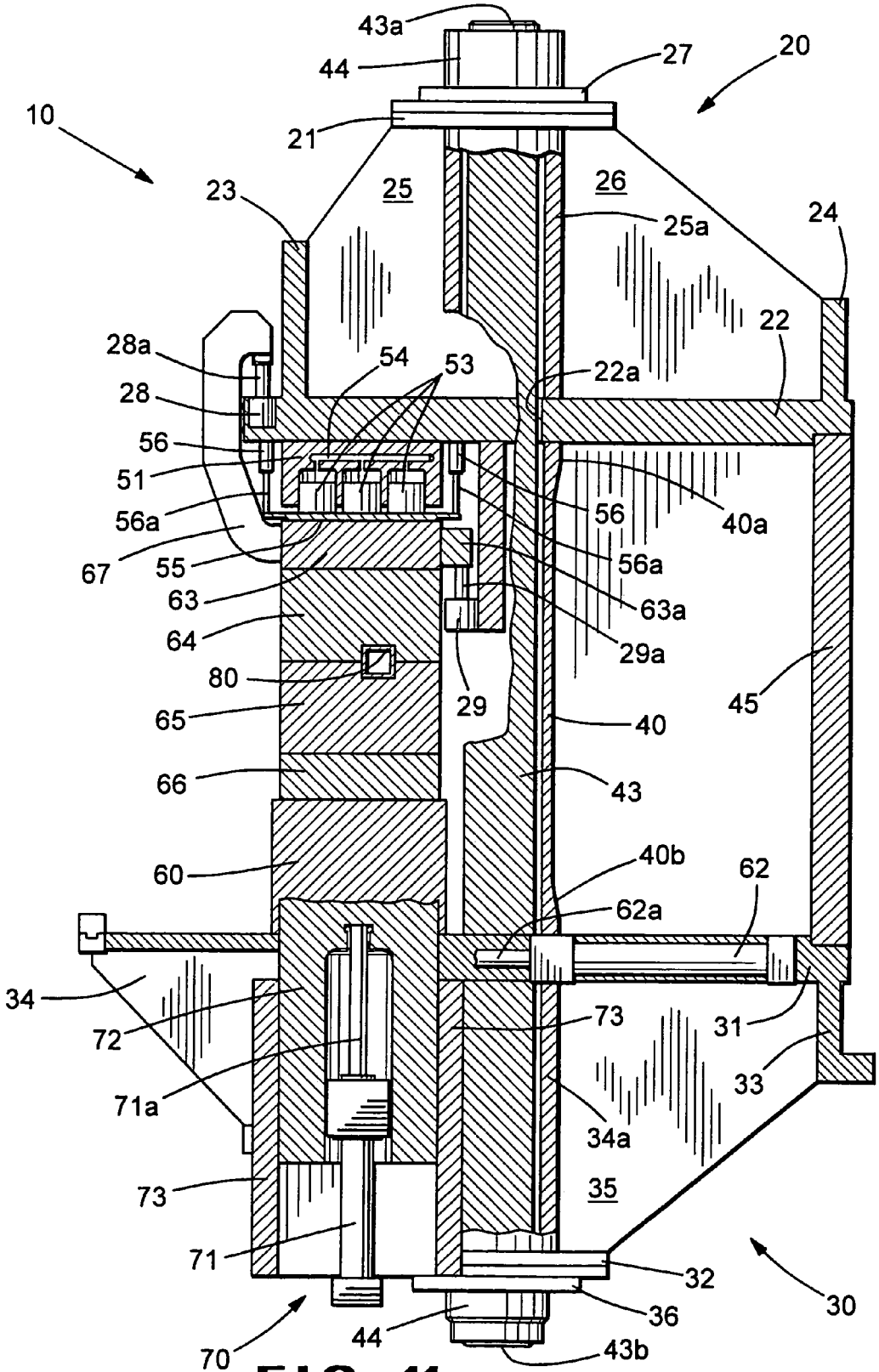
FIG. 11 is a sectional elevational view similar to FIG. 10 showing the pistons contained in the cylinder array after having been extended downwardly by pressurized fluid and after the application of pressurized fluid within the workpiece during the hydroforming operation.

Thereafter, the passageways 54 formed through the cylinder array 51 are placed in fluid communication with the source of pressurized fluid. The pressurized fluid causes the pistons 53 contained within the cylinder array 51 to be extended outwardly from their respective cylinders 52, exerting a relatively large downward force against the retainer plate 55 and the upper die mounting plate 63, as shown in FIG. 11. In this manner, the hydroforming die is securely clamped together, allowing the hydroforming operation to occur.

As mentioned above, conventional end feed cylinders (not shown) engage the ends of the workpiece 80 that protrude from the sides of the hydroforming die. Such end feed cylinders seal against the ends of the workpiece 80 and provide a mechanism for supplying pressurized fluid to the interior of the workpiece 80. In a manner that is well known in the art, such pressurized fluid causes the workpiece 80 to deform or expand outwardly into conformance with the die cavity defined by the upper and lower die sections 64 and 65, respectively. Because of the relatively large downward force exerted by the pistons 53 against the retainer plate 55 and the upper die mounting plate 63, and further because the lower die mounting plate 66 is positively supported on the moving bolster 60 and the lower platen 30 of the hydroforming apparatus 10, relative movement between the upper die section 64 and the lower die section 65 during the pressurization of the workpiece 80 is prevented.

It will be appreciated that during the hydroforming operation, relatively large reaction forces are generated against the front ends of the upper and lower platens 20 and 30 of the hydroforming apparatus 10. When viewing FIG. 11, it can be seen that such reaction forces tend to tilt the upper platen 20 in a clockwise direction about the tie rods 43 relative to the lower platen 30. Such reaction forces are, in large measure, absorbed by the backing plate 45 that extends between the rear ends of the upper and lower platens 20 and 30. From FIG. 11, it can be seen that the lateral distance from the centers of the tie rods 43 forwardly to the center of the hydroforming die (which is where the reaction forces are generated) is much smaller that the lateral distance from the centers of the tie rods 43 rearwardly to the backing plate 45 (which is where the reaction forces are absorbed). The mechanical advantage provided by the difference in distances allows the size of the backing plate 45 to be maintained relatively small. Thus, the overall size, weight, and expense of the hydroforming apparatus 10 is minimized.

Also, as mentioned above, the compression tubes 40 are pre-stressed with compressive forces by the tie rods 43 and the nuts 44. Because of the engagement of the upper plate 20 with the backing plate 45, the reaction forces generated during the hydroforming operation tend to generate tension forces in the compression tubes 40. Preferably, the pre-stressed compressive forces generated in the compression tubes 40 are predetermined to be approximately equal to or slightly greater than the maximum amount of such tension forces generated during the hydroforming operation. As a result, such tension forces tend to counteract the pre-stressed compressive forces in the compression tubes 40, as opposed to generating net tension forces in the compression tubes 40.

Figure 12:
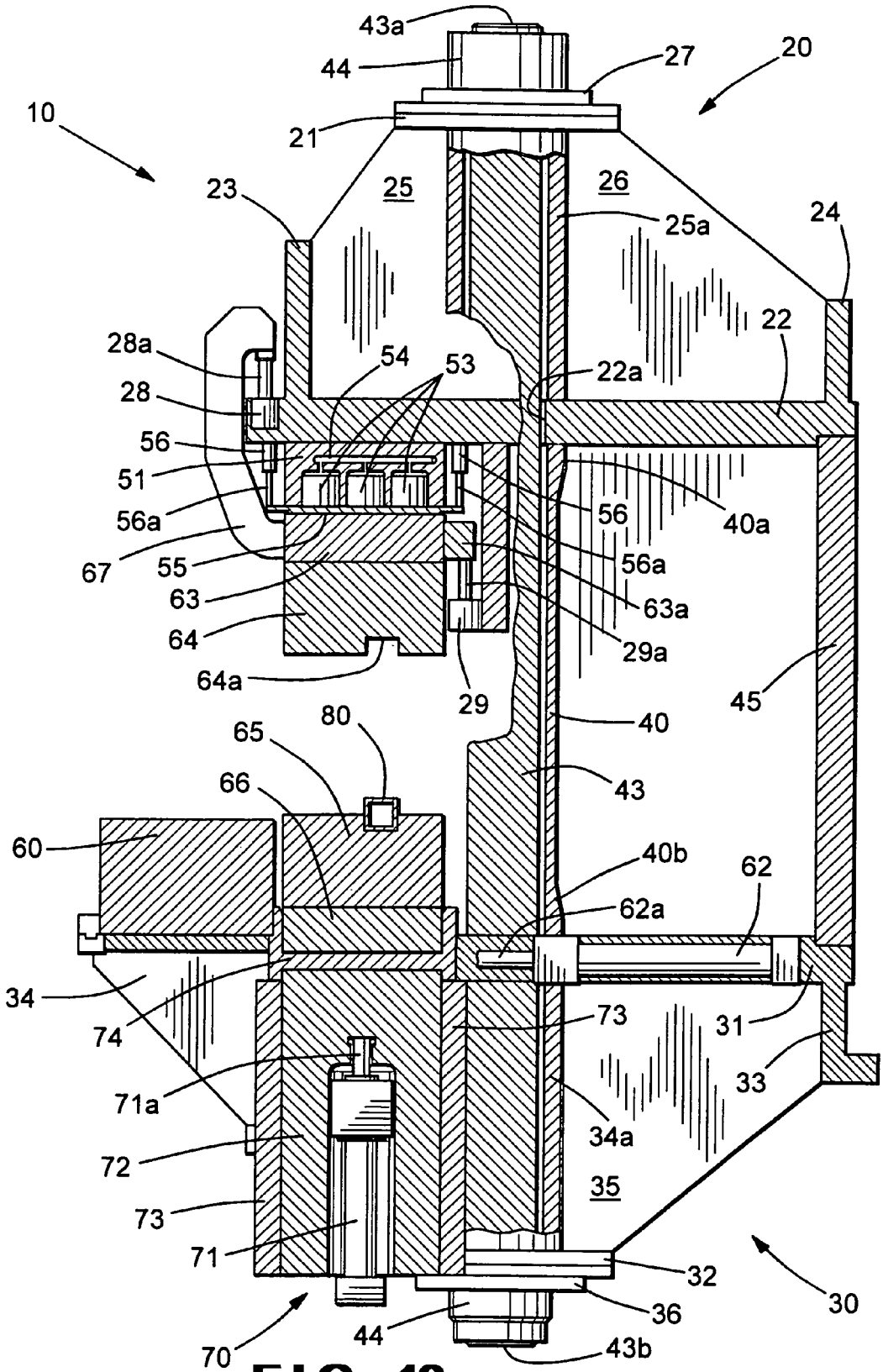
FIG. 12 is a sectional elevational view similar to FIG. 11 showing the moving bolster after being moved outwardly from the hydroforming apparatus and showing the lift cylinders after being actuated to lower the lower die section of the hydroforming die to complete the hydroforming process.

At the conclusion of the hydroforming of the workpiece 80, the passageways 54 formed through the cylinder array 51 are removed from fluid communication with the source of pressurized fluid, thereby releasing the relatively large clamping forces exerted against the hydroforming die. At about the same time, the hydraulic slide cylinders 62 are then be actuated to again retract the movable bolster 60 outwardly from within the hydroforming apparatus 10 as shown in FIG. 12. Thereafter, the pistons 71*a* of the lift cylinders 71 are retracted to lower the lower die mounting plate 66 and the lower die section 65 relative to the upper die section 64 and the upper die mounting plate 63. At the same time, the first and second hydraulic cylinders 28 and 29 can be actuated to extend their associated pistons 28*a* and 29*a* and again elevate the upper die mounting plate 63, the upper die section 64, and the retainer plate 55, causing the pistons 53 to be again retracted within their associated cylinders 52. The hydroformed workpiece 80 can then be removed to complete the cycle of the hydroforming operation.

As described above, the installation of the hydroforming die and the cycle of the hydroforming operation entails a series of sequential operations of the various components of the hydroforming apparatus 10. To accomplish these sequential operations quickly and safely, a plurality of sensors (not shown) are preferably provided on the hydroforming apparatus 10. Such sensors are conventional in the art and are adapted to generate electrical signals that are representative of various operating conditions of the hydroforming apparatus 10. The sensed operating conditions can include position sensors to insure that the moving components of the hydroforming apparatus 10 actually achieve their desired positions before proceeding with the next step in the cycle of the hydroforming operation, pressure sensors to insure that proper pressurization is achieved within the cylinder array 51, and the like. The signals from such sensors can be fed to one or more electronic controllers (not shown) for actuating the various components of the hydroforming apparatus 10. The electronic controllers are conventional in the art and can be programmed to monitor the signals from the various sensors and, in response thereto, cause the sequential operations set forth above to be performed. The structure and operation of the sensors and the electronic controllers is within the knowledge of a person having ordinary skill in the art.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An apparatus for performing a hydroforming operation comprising:

a lower platen;

a lower die section carried on said lower platen;

an upper platen supported relative to said lower platen;

an upper die section having a suspension arm that is supported on said upper platen;

a lift cylinder for selectively elevating said lower die section upwardly into engagement with said upper die section; and a bolster that is movable between a first position, wherein said bolster is disposed between said lower die section and said lower platen, and a second position, wherein said bolster is not disposed between said lower die section and said lower platen.

2. The apparatus defined in claim 1 wherein said upper platen is supported on said lower platen by a member that extends between said upper platen and said lower platen.

3. The apparatus defined in claim 2 wherein said member is a tube having a tie rod extending therethrough, said tie rod causing said tube to be normally maintained in compression.

4. The apparatus defined in claim 1 wherein said upper die section is supported for relative movement on an upper die clamping assembly connected to said upper platen.

5. The apparatus defined in claim 4 wherein said upper die clamping assembly further includes a passageway for receiving pressurized fluid and for exerting forces on said upper die section during the hydroforming operation.

6. The apparatus defined in claim 4 wherein said upper die clamping assembly further includes a cylinder array for receiving pressurized fluid and for exerting forces on said upper die section during the hydroforming operation.

7. The apparatus defined in claim 1 wherein respective lift cylinders are provided on the lateral ends of said lower platen for selectively elevating said lower die section upwardly into engagement with said upper die section.

8. The apparatus defined in claim 1 further including a first hydraulic cylinder supported on said upper platen, said first hydraulic cylinder engaging said suspension arm to carry said upper die section on said upper platen.

9. The apparatus defined in claim 8 a further including a second hydraulic cylinder supported on said upper platen, said second hydraulic cylinder engaging said upper die section to carry said upper die section on said upper platen.

10. The apparatus defined in claim 1 wherein said suspension arm is generally C-shaped.

11. An apparatus for performing a hydroforming operation comprising:

a lower platen;

a lower die section carried on said lower platen;

an upper platen supported relative to said lower platen;

an upper die section having a suspension arm;

a hydraulic cylinder supported on said upper platen, said hydraulic cylinder engaging said suspension arm to carry said upper die section on said upper platen;

a lift cylinder for selectively elevating said lower die section upwardly into engagement with said upper die section; and a bolster that is movable between a first position, wherein said bolster is disposed between said lower die section and said lower platen, and a second position, wherein said bolster is not disposed between said lower die section and said lower platen.

12. The apparatus defined in claim 11 wherein said upper platen is supported on said lower platen by a member that extends between said upper platen and said lower platen.

13. The apparatus defined in claim 12 wherein said member is a tube having a tie rod extending therethrough, said tie rod causing said tube to be normally maintained in compression.

14. The apparatus defined in claim 11 wherein said upper die section is supported for relative movement on an upper die clamping assembly connected to said upper platen.

15. The apparatus defined in claim 14 wherein said upper die clamping assembly further includes a passageway for receiving pressurized fluid and for exerting forces on said upper die section during the hydroforming operation.

16. The apparatus defined in claim 14 wherein said upper die clamping assembly further includes a cylinder array for receiving pressurized fluid and for exerting forces on said upper die section during the hydroforming operation.

17. The apparatus defined in claim 11 wherein respective lift cylinders are provided on the lateral ends of said lower platen for selectively elevating said lower die section upwardly into engagement with said upper die section.

18. The apparatus defined in claim 17 wherein said hydraulic cylinder is a first hydraulic cylinder, and further including a second hydraulic cylinder supported on said upper platen, said second hydraulic cylinder engaging said upper die section to carry said upper die section on said upper platen.

19. The apparatus defined in claim 11 wherein said suspension arm is generally C-shaped.

* * * * *